United States Patent [19]

Akerman et al.

[11] Patent Number: 4,878,804

[45] Date of Patent: Nov. 7, 1989

[54] CIRCULATING PUMP

[75] Inventors: Paul Akerman, Münsingen; Wolfram Meyer, Hilterfingen, both of Switzerland

[73] Assignee: Bieri Pumpenbau AG, Sudstrasse, Switzerland

[21] Appl. No.: 242,486

[22] Filed: Sep. 12, 1988

[30] Foreign Application Priority Data

Sep. 15, 1987 [CH] Switzerland ..... 3553/87

[51] Int. Cl.[4] ..... F04D 29/06

[52] U.S. Cl. ..... 415/111; 415/175; 417/371

[58] Field of Search ..... 415/175, 176, 110, 111; 417/371, 372, DIG. 902

[56] References Cited

U.S. PATENT DOCUMENTS

| | | | |
|---|---|---|---|
| 2,844,302 | 7/1958 | Weibel, Jr. | 417/902 |
| 2,913,988 | 11/1959 | White | 415/178 |
| 3,067,690 | 12/1962 | Kramer et al. | 417/371 |
| 3,163,116 | 12/1964 | McCourty et al. | 415/143 |
| 3,169,696 | 2/1965 | Warner | 417/902 |
| 3,667,870 | 6/1972 | Yoshida et al. | 415/88 |

FOREIGN PATENT DOCUMENTS

| | | | |
|---|---|---|---|
| 3538225 | 4/1987 | Fed. Rep. of Germany | 415/53 R |
| 3622269 | 1/1988 | Fed. Rep. of Germany | 415/170 A |
| 225294 | 11/1986 | Japan | 415/111 |

*Primary Examiner*—Robert E. Garrett
*Assistant Examiner*—John T. Kwon
*Attorney, Agent, or Firm*—Zarley, McKee, Thomte, Voorhees & Sease

[57] ABSTRACT

A bearing cap (16) is sealingly inserted between a front bearing bush (3) and a fluid-tight sleeve (17). Between a front portion (10) of a rotor shaft (5) and the front bearing bush, two overlying lubricating grooves (11, 12) are disposed. On a rear portion (13) of the shaft, a baffle plate (20) having vanes is mounted, an annular gap (21) existing between the shaft and the inside diameter of the vanes. Between the rear portion of the shaft and a rear bearing bush (4), lubricating grooves (14, 15) are formed continuously. The rotor chamber is quickly vented, no contamination thereof taking place. Lubrication and heat evacuation from the rotor chamber are ensured.

5 Claims, 2 Drawing Sheets

CIRCULATING PUMP

This invention relates to water-supply equipment, and more particularly to a circulating pump, especially for hot water plants, of the type having a pump housing, a shaft mounted between bearing bushes and having a rotor provided with longitudinal grooves and a fluid-tight sleeve disposed between the rotor and a stator, as well as an impeller connected to the shaft.

In prior art circulating pumps, where the shaft with the rotor is mounted in carbon bearing bushes, there is a clearance between the front bearing bush and the end of the shaft nearest the impeller. Furthermore, there is a narrow gap between the bearing cap disposed over the front bearing bush, adjacent to the impeller, and the fluid-tight sleeve. The lubrication groove at the end of the shaft mounted in the rear bearing bush is not continuous.

A drawback of this arrangement is that contaminants can get into the pump from the liquid to be heated and can lead to blocking thereof.

It is an object of this invention to provide a circulating pump particularly for hot-water plants, in which no contamination of the rotor chamber occurs, and venting takes place as quickly as possible.

A further object of the invention is to provide an improved circulating pump in which lubrication and heat evacuation from the rotor chamber are ensured.

To this end, in the circulating pump according to the present invention, of the type initially mentioned, the improvement comprises at least one baffle plate disposed between the rotor and a bearing bush, there being a gap between the outside diameter of the shaft and the inside diameter of the baffle plate, and at least one lubrication groove disposed in each of the bearing bushes.

A preferred embodiment of the invention and its use will now be described in detail with reference to the accompanying drawings, in which.

Figure 1:
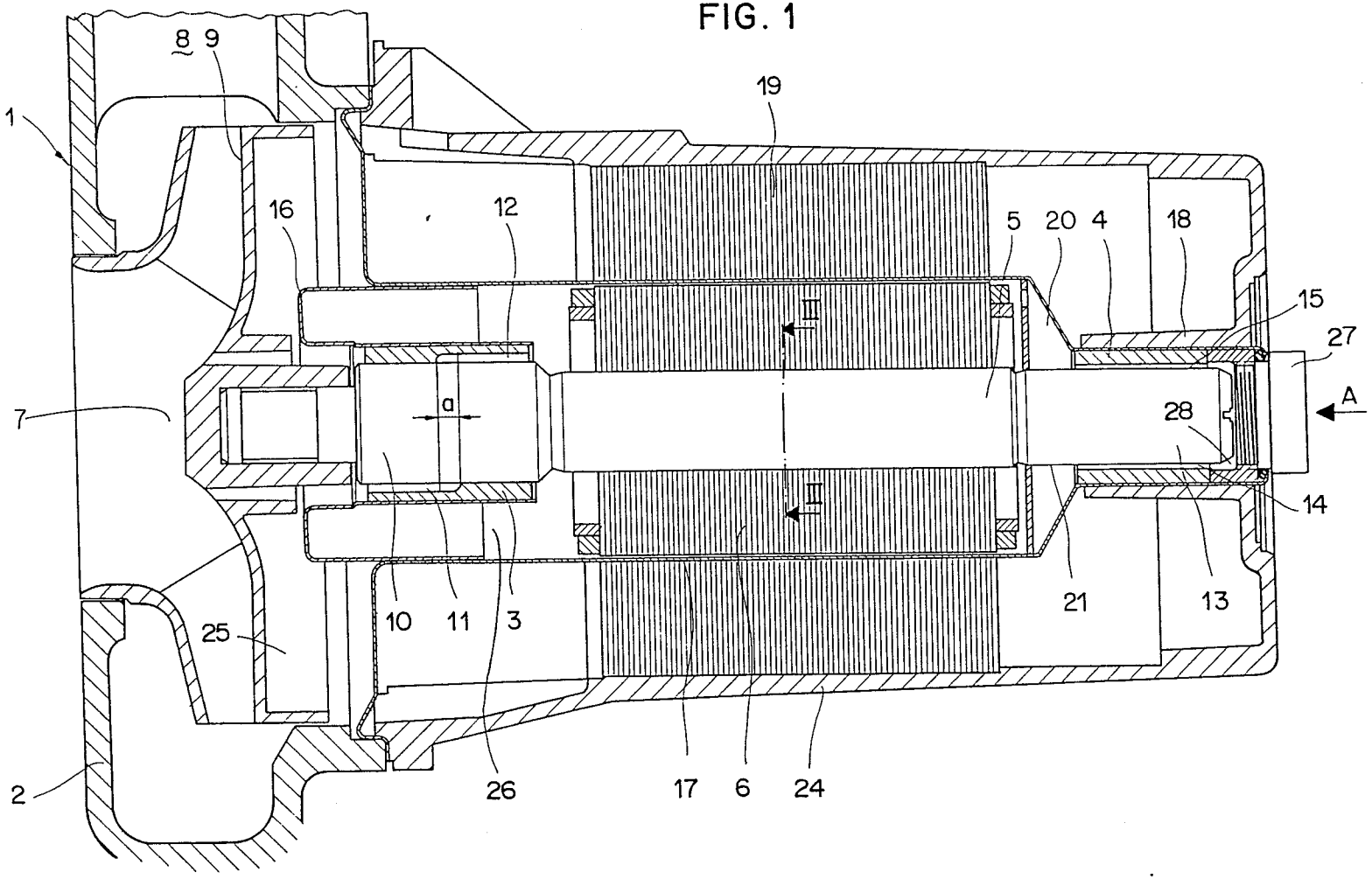
FIG. 1 is a section through the circulating pump for hot-water plants.

The circulating pump 1 illustrated in FIG. 1 comprises a pump housing 2 and a shaft 5 having a rotor 6 and mounted centrally in housing 2 in bearing bushes 3 and 4 of carbon. Attached to shaft 5 in the region of a water inlet 7 and a discharge 8 is an impeller 9. Disposed between the front bearing bush 3 and a portion 10 of shaft 5, somewhat broadened in this region, are two lubrication grooves 11 and 12 partially overlapping in a zone a. Two lubrication grooves 14 and 15 are likewise provided between the rear portion 13 of shaft 5 and the rear bearing bush 4. The front bearing bush 3 is disposed partially within a bearing cap 16. A fluid-tight sleeve 17 is affixed between a mounting 18 of a motor housing 24 and rear bearing bush 4 and between rotor 6 and a stator 19. Sleeve 17 is bent at a right angle in the vicinity of bearing cap 16. Mounted within fluid-tight sleeve 17, in the area between rear bearing bush 4 and rotor 6, is a baffle plate 20 which is pressed into fluid-tight sleeve 17. A narrow gap 21 is provided between part of rear portion 13 of shaft 5 and baffle plate 20. A device for controlling the direction of rotation, taking the form of a threaded nose cap 27, serves to close off the motor end of pump 1 toward the outside.

Figure 2:
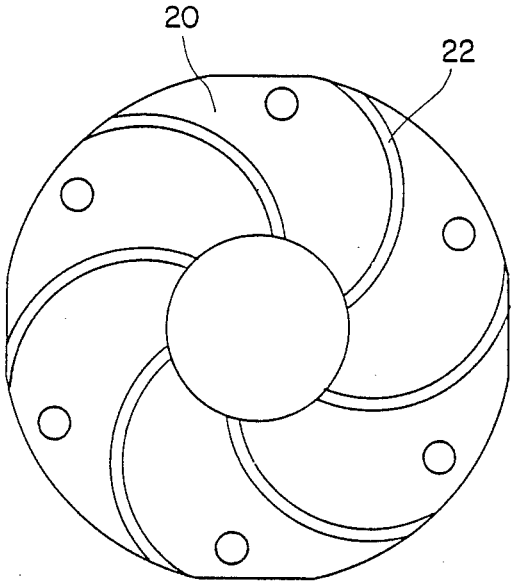
FIG. 2 is an elevation according to arrow A of FIG. 1.

FIG. 2 is an end-on view, according to arrow A of FIG. 1, of baffle plate 20 with vanes 22.

Figure 3:
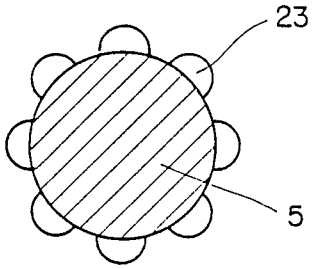
FIG. 3 is a section taken on the line III—III of FIG. 1.

FIG. 3 shows a section taken on the line III—III of FIG. 1. It is apparent from this drawing figure that longitudinal grooves 23 are provided between shaft 5 and rotor 6.

In the inventive circulating pump being described, intended especially for hot-water plants, bearing cap 16 is inserted sealingly between front bearing bush 3 and fluid-tight sleeve 17. The water reaching a rotor chamber 26 through lubrication grooves 11 and 12 after filling of the plant is drawn along by the rotor as it turns and conveyed between rotor 6 and fluid tight sleeve 17 toward the rear bearing. The air compressed in rotor chamber 26 passes through longitudinal grooves 23, 12, 11 into a chamber 25 bounded by impeller 9, pump housing 2, and fluid-tight sleeve 17 and is exhausted in the hot water being pumped. The outside diameter of shaft 5 is about 0.5 mm less than the inside diameter of the vanes of baffle plate 20, so that a narrow gap is formed between rear portion 13 of shaft 5 and rear bearing bush 4. What is important is that the air be quickly removed from rotor chamber 26 since the bearings are also lubricated by the water. After the air in rotor chamber 26 has been exhausted and the latter is completely filled with water, there is an equilibrium of pressure between rotor chamber 26 and the adjacent pump chamber 25. The water now in rotor chamber 26 remains there. Since no exchange of water caused by pressure differentials takes place between chambers 25 and 26, neither does any refuse conveyed by the hot water get into bearings 3, 4 and rotor chamber 26. Besides this, the water cools rotor chamber 26 by about 70%. The evacuation of heat takes place via the portion of bearing cap 16 projecting into chamber 25. The residual heat is evacuated to the outside via the motor housing. Lubrication grooves 14 and 15 between rear portion 13 of shaft 5 and rear bearing bush 4 are continuous. Faultless venting takes place from space 28 as well, without water squirting out at the back when nose cap 27 is removed.

The inventive circulating pump also presents the advantage, among others, that the motor chamber is quickly filled with the material to be conveyed, and the venting system operates over the entire range of characteristics of the pump.

What is claimed is:

1. A circulating pump, especially for hot-water plants, of the type having a pump housing, at least two bearing bushes, a shaft mounted between the bearing bushes, a rotor provided with longitudinal grooves mounted on the shaft, a stator, a fluid-tight sleeve disposed between the rotor and the stator, and an impeller connected to the shaft, wherein the improvement comprises:

at least one baffle plate having a center aperture encircling said shaft between said rotor and one of said bearing bushes, the diameter of said aperture being slightly greater than the diameter of said shaft, whereby a gap is formed between said shaft and said baffle plate, and at least one lubrication groove disposed in each of said bearing bushes.

2. The circulating pump of claim 1, wherein one of said bearing bushes is situated adjacent to said impeller, said circulating pump comprising two non-continuous, overlapping lubrication grooves disposed in said one of said bearing bushes.

3. The circulating pump of claim 1, wherein one of said bearing bushes is situated adjacent to said impeller, further comprising a bearing cap sealingly inserted between said one of said bearing bushes and said fluid-tight sleeve.

4. The circulating pump of claim 1, wherein one of said bearing bushes is situated adjacent to said baffle plate, further comprising at least two continuous lubricating grooves disposed between said one of said bearing bushes and the end portion of said shaft remote from said impeller.

5. The circulating pump of claim 1, wherein said baffle plate is provided with a plurality of vanes.

* * * * *